United States Patent [19]

Mertz

[11] Patent Number: 4,612,783

[45] Date of Patent: Sep. 23, 1986

[54] SELECTIVELY VARIABLE FLOWRATE EXPANSION APPARATUS

[75] Inventor: Denny W. Mertz, St. Louis County, Mo.

[73] Assignee: Emerson Electric Co., St. Louis, Mo.

[21] Appl. No.: 733,909

[22] Filed: May 14, 1985

Related U.S. Application Data

[63] Continuation-in-part of Ser. No. 646,980, Sep. 4, 1984, abandoned.

[51] Int. Cl.[4] ..... F25B 41/06

[52] U.S. Cl. ..... 62/528; 62/504; 251/207

[58] Field of Search ..... 251/207, 208, 209, 304; 62/504, 528, 222–225

[56] References Cited

U.S. PATENT DOCUMENTS

| | | | |
|---|---|---|---|
| 1,017,292 | 2/1912 | Hyde | 251/207 |
| 2,701,704 | 2/1955 | Lawrence | 251/207 |
| 3,139,903 | 7/1964 | Lonn | 251/207 |
| 3,326,232 | 6/1967 | Stamps et al. | 251/207 |
| 4,448,412 | 5/1984 | Brentham | 251/207 |

*Primary Examiner*—James C. Yeung

*Attorney, Agent, or Firm*—Polster, Polster and Lucchesi

[57] ABSTRACT

A selectably variable flowrate expansion apparatus is disclosed comprising a main body having a flow path, the flow path including an inlet and an outlet for the flow of refrigerant therethrough. The main body has a plug member sealably mounted therewithin, this plug member being selectively rotatable relative to the main body between a plurality of discrete flow positions. The plug body has an outlet manifold chamber in communication with the outlet of the flow path in the main body, the outlet manifold being generally coaxial with the axis of rotation of the plug member. The plug body further has a plurality of orifice bores, each of a different predetermined cross section, extending generally radially outwardly from the manifold chamber, there being one orifice bore for each of the above-mentioned discrete flow positions, such that with the plug body in one of its discrete flow positions, a predetermined flowrate of refrigerant will pass through a selected orifice bore of the plug body.

6 Claims, 5 Drawing Figures

SELECTIVELY VARIABLE FLOWRATE EXPANSION APPARATUS

CROSS REFERENCE TO RELATED APPLICATION

This is a continuation-in-part application of U.S. patent application Ser. No. 646,980, filed Sept. 4, 1984, now abandoned.

BACKGROUND OF THE INVENTION

This invention relates to a selectively variable flowrate expansion apparatus or device for use on a refrigeration system for permitting the adiabatic expansion of a liquified refrigerant prior to the refrigerant entering an evaporator.

Generally, in a refrigeration system, it is necessary for liquified refrigerant (e.g., Freon or the like to undergo an adiabatic expansion process prior to the refrigerant entering the evaporator of the refrigeration system for removing heat from the environs of the evaporator. Typically, the expansion device may, in its simplest form, be constituted by a metering orifice or a capillary tube installed in the refrigerant line leading to the evaporator. The high pressure liquified refrigerant is forced or metered through the opening of the orifice or through the bore of the capillary tube, and permitted to adiabatically expand as it passes therethrough (or after it is passed through the orifice), such that the pressure on the liquid refrigerant is reduced within the evaporator, thus permitting the refrigerant to be readily vaporized in the evaporator. In other refrigeration systems, the expansion device comprises a so-called thermostatic expansion valve which has a spring biased valve member operable by a diaphragm actuator, the latter being responsive to evaporator temperatures by means of a capillary sensor bulb. Such an adjustable thermostatic expansion device is shown in U.S. Pat. No. 3,129,903. The valve of a thermostatic expansion valve is typically operable to permit increased or decreased refrigerant flow through the evaporator, dependent on the temperature of the refrigerant leaving the evaporator, which in turn is responsive to the heat load on the evaporator.

While thermostatic expansion valves are advantageous in that they regulate the flow of refrigerant through the evaporator so as to maintain a constant superheat, even though the system may experience different demands, thermostatic expansion valves are considerably more complicated and more expensive than simple orifices or capillary expansion devices. Capillary expansion devices, however, only permit a fixed flowrate of refrigerant therethrough, and thus the refrigeration system is not readily adjustable so as to vary the flowrate of refrigerant through the evaporator. In many prior orifice metering devices it was necessary to open up the refrigerant system to change orifices thereby resulting in a loss of refrigerant. Reference may be made to such U.S. Pat. Nos. 3,642,030 and 3,877,248 which illustrate prior art fixed orifice expansion devices.

In an effort to overcome the disadvantages of prior capillary or orifice expansion devices, variable or adjustable orifice or capillary tube expansion devices were developed. Such variable or adjustable expansion devices are shown in U.S. Pat. Nos. 4,184,342, 4,263,787, and 4,394,816. While these devices may have worked well for their intended purposes, they either were relatively of complicated construction and were difficult to adjust, or required a control system for automatic operation thereof.

Other prior art valves are known which may be material to the present invention. U.S. Pat. No. 1,017,292 discloses a steam valve having a cylindrical plug body which is rotatably received in a casing. A series of radial holes is provided in the plug body such that when one or more of the holes is in register with a radial neck, steam is free to flow through the valve. Importantly, the valve is not used in two-phase fluid service, as in an expansion device. Also, the size and spacing of holes in the plug body and the size of bore of the radial neck are such that more than one hole could be in register with the bore of the radial neck. This would make the steam valve difficult to use as a refrigerant expansion device.

U.S. Pat. No. 4,448,412 discloses an exercising apparatus which uses double acting hydrualic cylinders to act as a resistance exercise device. A rotatable, multiple position plug valve is used to meter the flow of hydraulic fluid into and out of the hydraulic cylinder thereby to change the resistance of the cylinder. However, this valve is not used as a refrigerant expansion device.

Lawrence, U.S. Pat. No. 2,701,704, discloses a valve which automatically cuts off the flow of fluid after a given quantity of fluid has passed through the valve. A valve plunger is slidably mounted with a cylindrical housing and is axially movable between an open position in which fluid may flow through the valve housing via a transverse bore in the valve plunger and a closed position in which flow is blocked. The valve plunger is spring-loaded toward its open position. Fluid from the inlet side of the valve is metered into a cylinder and piston arrangement via a pilot passage and an adjustable metering valve. When the cylinder is filled with fluid and is pressurized to a sufficient level, such as after there has been fluid flow through the valve for a predetermined length of time, the pressure forces on the valve plunger will overcome the spring and close the valve. However, this prior patent is not useful as a refrigerant expansion device.

Stamps et al, U.S. Pat. No. 3,326,232, discloses fertilizer application apparatus and has a rotary plug valve having a number of metering bores. However, this fertilizer application apparatus is not useful as a refrigerant expansion device.

None of these prior art references disclosed or suggested a refrigerant metering device having fixed capillary orifice bores which could be adjusted without opening the flow of refrigerant to vary the flow rate of a refrigerant and the superheat of a refrigeration system.

SUMMARY OF THE INVENTION

Among the several objects and features of the present invention may be noted the provision of a selectively variable flowrate expansion apparatus or device which permits a service technician to readily adjust the flow rate of refrigerant through the expansion device so as to match the heat load placed on the refrigeration system with the flow of refrigerant therethrough.

The provision of such a selectively variable flowrate expansion apparatus which utilizes a simple orifice bore, but yet permits the cross sectional area of the orifice bore to be selectively varied to any one of a number of predetermined cross sectional areas without the necessity of opening the refrigeration system to change the orifice bore size.

The provision of such a selectively variable flowrate expansion device in which the ratio of the diameter of each of the orifice bores to the length of the orifice bores is such as to optimize the efficiency of the expansion of the refrigerant.

The provision of such a selectively variable flowrate expansion apparatus which is of simple construction, which is small in size, which is of low cost to manufacture, which is readily adjustable by even relatively unskilled refrigeration service personnel in the field, and which is reliable in operation.

Other objects and features of this invention will be in part pointed out and in part apparent hereinafter.

Briefly stated, a selectively variable flowrate expansion apparatus or device of the present invention comprises a main body having a flow path therethrough, the flow path having an inlet and an outlet for the flow of refrigerant therethrough. The main body has a plug member sealably mounted therewithin, this plug member being selectively movable relative to the main body between a plurality of discrete flow positions. The plug member has an outlet manifold in communication with the outlet of the flow path in the main body. The plug member has a plurality of orifice bores each of a predetermined cross section, these orifice bores extending between the manifold and the surface of the plug body adjacent the flow path inlet. One orifice bore is provided for each of the above-stated discrete flow positions for the apparatus such that with the plug member being in one of its discrete flow positions, a predetermined flow rate of refrigerant will pass through the selected orifice bore of the plug member.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
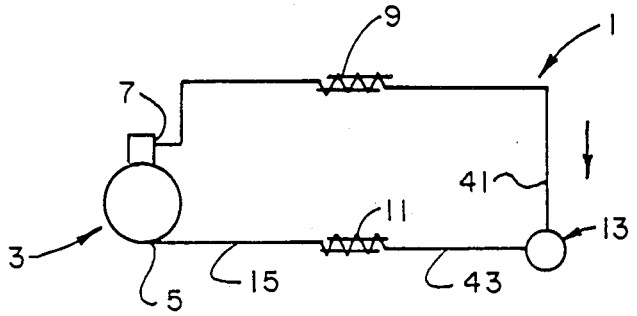
FIG. 1 is a schematic view of a typical refrigeration system, including a selectively variable flowrate expansion device of the present invention, shown in a somewhat enlarged scale.

Referring now to the drawings, and more specifically to FIG. 1, a typical refrigeration system, as indicated in its entirety by reference character 1, is shown to comprise a compressor 3 having a refrigerant inlet 5 and a high pressure refrigerant outlet 7. The high pressure refrigerant from compressor outlet 7 is passed through a condenser 9 in which the temperature of the refrigerant is lowered. Then the cooled, high pressure refrigerant is passed through an evaporator 11 in which heat from the surroundings of the evaporator is absorbed by the refrigerant, thus lowering the temperature of the surroundings of the evaporator. A selectably variable flowrate expansion apparatus or device of the present invention, as indicated generally by reference character 13, is provided in the refrigerant line between condenser 9 and evaporator 11 for permitting the adiabatic expansion of the refrigerant prior to its entering the evaporator. The refrigerant, upon exiting the evaporator, is fed back into the compressor inlet 5 by means of a suction line 15. While refrigeration system 1 is shown to comprise a standard refrigeration system, those skilled in the art will understand that the expansion apparatus 13 of the present invention can be utilized on a variety of refrigeration systems, including heat pumps operable both in a cooling and a heating mode.

Referring now to FIGS. 2–5, the construction and operation of the selectably variable flowrate expansion apparatus 13 will now be defined. More specifically, in FIG. 2, expansion device 13 is shown to comprise a main body 16 having a flow path, as generally indicated at F, extending therethrough with the flow path having an inlet 17 and an outlet 19. Main body 16 is provided with a counterbore 21 in the top face thereof, with the counterbore being defined by a cylindric side wall 23 within main body 16, and by a flat bottom wall 25 generally perpendicular to cylindric side wall 23. An opening 26 is provided in side wall 23 in register with inlet 17 for purposes as will appear.

Figure 4:
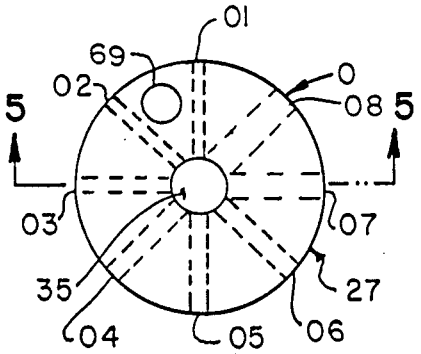
FIG. 4 is a bottom plan view of a plug body of the device.

A plug member, as generally indicated at 27, is rotatably mounted within counterbore 21 of main body 16 for rotation relative to the main body between a plurality of discrete flow positions. Plug member 27 has a cylindric plug body 29, with the plug body having a cylindrical side wall 31 (see FIG. 5) which is sealably, slidably received within counterbore 21. The plug body further has a bottom wall 33 which is adapted to be in generally face-to-face relation with the flat bottom wall 25 of counterbore 21 in main body 16. The plug body further has a central outlet manifold chamber 35 which is concentric with the cylindric plug body and which is concentric with the axis of rotation of the plug body within counterbore 21 of main body 16. The central outlet manifold 35 is shown to be a blind hole provided in bottom wall 33 of the plug body. Further, the plug body is provided with a plurality of orifice bores, as generally indicated at 0. More specifically, in the embodiment herein disclosed, eight such orifice bores are provided in plug body 27, with each of the orifice bores extending radially outwardly from central manifold 35, and with the orfice bores being generally equally angularly spaced around the plug body. As best shown in FIG. 4, each of the orifice bores $O_1$–$O_8$ is of a progressively larger diameter or cross section such that each of the orifice bores $O_1$–$O_8$ is of a predetermined cross section and length so as to allow a predetermined flowrate of refrigerant therethrough, the flowrate being dependent on the cross section and length of the orifice bore through which the refrigerant is flowing. Central manifold 35 is substantially larger in cross section than the largest of the orifice bores $O_1$–$O_8$.

Main body 16 has a liquid inlet line 41 sealably secured to the side of the main body for receiving refrigerant from condenser 9, and has a refrigerant outlet line 43 sealably secured to the bottom face of the main body member so as to receive the refrigerant as it passes through a selected orifice bore O and is exhausted into the outlet line 43 via manifold chamber 35 and the outlet portion 19 of flow path F.

Figure 5:
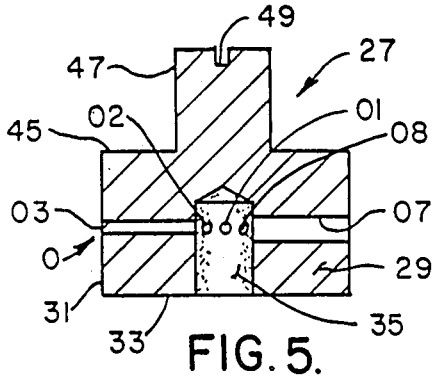
FIG. 5 is a cross sectional view of the plug body, taken along line 5—5 of FIG. 4.
Figure 2:
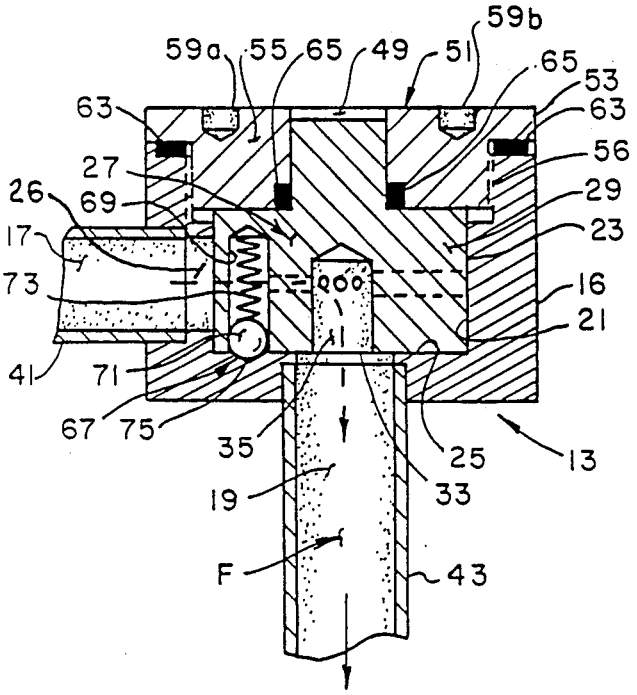
FIG. 2 is a vertical cross sectional view of the selectively variable flowrate expansion device of the present invention, shown in a somewhat enlarged scale.

As best shown in FIGS. 2 and 5, plug member 27 has a shoulder 45 on the upper end of the cylindric plug body 29, and further has an upwardly extending stem 47 coaxial with respect to the plug body 29. A screwdriver slot 49 or the like is provided in the upper end face of stem 47 to facilitate rotation of plug member 27 within main body 16 in a manner as will appear hereinafter.

Expansion device 13 further includes a cover 51 which has an outwardly extending upper shoulder 53, and a downwardly extending central cover body 55. Threads 56 are provided on the outer surface of cover 51 and on the inner upper portion of counterbore 21 of main body 16 such that cover 51 may be threadably inserted into counterbore 21. As indicated at 59*a*, 59*b*, a pair of diametrically opposed blind openings is provided in the upper face of cover 51 for receiving a spanner wrench or the like so as to permit cover 51 to be sealably secured to main body 16, and to permit the removal of the cover. Further, cover 51 has a central opening 61 therein for sealably receiving stem 47 of plug member 27.

As indicated at 63, a cover-to-body seal or gasket is provided for positively sealing the cove with respect to main body 16. Further, a cover-to-plug seal 65 is provided between the inner lower portions of cover body 55 surrounding the central cover opening 61, with the last-mentioned seal being slidably, sealably engageable with the base of stem 47 of plug member 27. Seals 63 and 65 thus prevent the escape of refrigerant from the expansion device 13 of the present invention and yet permit the plug member to be rotated within main body 16.

As heretofore mentioned, cylindric plug body 29 has a sliding, sealing fit with the cylindric side walls 23 of counterbore 21 of main body 16 so as to effectively block the flow of refrigerant in the space between the cylindric plug body 29 and cylindric side walls 23 of counterbore 21. Thus, with the plug member in one of its selected, discrete flow positions, one of the orifice bores $O_1$–$O_8$ will be in register with opening 26 in the cylindric side wall 23 of main body member 16 so that the full flow of refrigerant through expansion device 13 is through the selected orifice bore into manifold chamber 35.

Further, means, as generally indicated at 67, is provided for positively positioning plug member 27 relative to opening 26 in main body 16 such that only one respective orifice $O_1$–$O_8$ is in register with opening 26 in each of the discrete flow positions of plug member 27 relative to the main body 16. This means 67 is herein shown to be a spring biased detent positioning means which is constituted by a detent bore 69 provided in the bottom face of plug member 27 between two of the orifice bores (e.g., between 01 and 02, as shown in FIG. 4). A detent ball 71 is installed in detent bore 69, and the detent ball is biased downwardly relative to plug member 27 by means of a detent compression coil spring 73 such that at least the bottom portions of detent ball 71 protrudes down below the bottom face 33 of cylindric plug body 29, generally as shown in FIG. 2. Further, a plurality of detent recesses 75 are provided in bottom wall 25 of main body member 16 such that with the detent ball being received in a respective detent recess 75, only one orifice bore $O_1$–$O_8$ will be in register with opening 26 in main body side wall 23.

Figure 3:
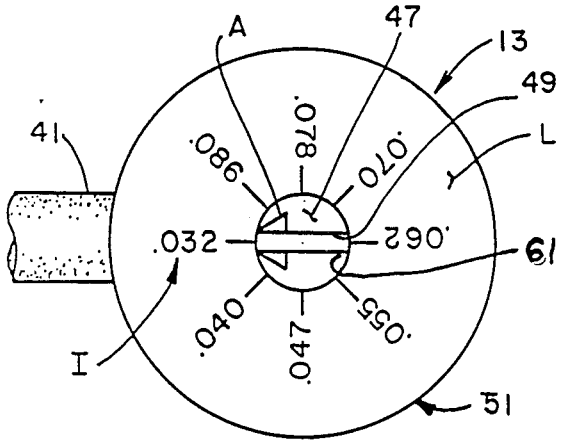
FIG. 3 is a top plan view of FIG. 2.

As shown in FIG. 3, indicia I may be provided on a label L on the top face of stationary cover 51, and an arrow A may be provided on the top face of stem 47 at one end of slot 49 so that as the stem and plug member 27 are rotated relative to main body 16, the size of the orifice bore O in register with opening 26 is readily visible to the refrigerant technician. In that manner, any one of the metering orifices $O_1$–$O_8$ may be randomly, selectively utilized to throttle the flow of refrigerant to evaporator 11 such that the flow of refrigerant may be selectively controlled, according to the cross section or diameter of the orifice selected, thus permitting the refrigeration technician to manually adjust the flow of refrigerant through the system without the necessity of having to open the refrigeration system (with a consequent loss of refrigerant). In this manner, it will be appreciated that the advantages of a relatively simple orifice expansion device may be realized (i.e., simple construction, low cost, and reliability of operation) without sacrificing adjustability of the expansion device, depending on the heat load requirements placed on the refrigeration system. Also, it is not necessary to open the refrigeration system (with a consequent loss of refrigerant) to change the size of the orifice.

In accordance with this invention, the diameters of orifice bores $O_1$–$O_8$ relative to their length are sized so as to have a length L to diameter D ratio of about at least 3 to about less than about 12 (i.e., $3 \leqq L/D \leqq 12$). This ensures that each of the orifice bores $O_1$–$O_8$ has a length sufficient to permit the orifice bore to at least in part act as a capillary tube expansion device by creating a desired pressure drop across the selected orifice bore thereby to permit rapid expansion of the liquid refrigerant downstream from the orifice bore and yet to restrict the flow of refrigerant to a desired flowrate which is sufficient to wet nearly all of the length of evaporator 11 and to provide only a sufficient superheat (e.g., 5°–10° F.) so as to prevent liquid refrigerant from being returned to the suction side of compressor 3 for a relatively constant load on refrigeration system 1. Of course, by providing a number of different size orifice bores $O_1$–$O_8$, the flowrate of the refrigerant through the evaporator 11 may, within a limited range, be matched to the load imposed on the refrigeration system 1.

As one example of a particular embodiment of the expansion device of the present invention, eight orifice bores O may be provided in plug body 25, with the diameters (or cross sections) of the orifice bores having a diameter ranging between about 0.032–0.086 inches (0.81–2.2 mm.;. Further, the diameter of cylindric plug body 29 may, for example, be about 0.812 inches (20.6 mm.), while the diameter of outlet manifold 35 may be about 0.187 inches (4.7 mm.), such that the length of each of the orifices $O_1$–$O_8$ is about 0.312 inches (7.9 mm.). It can be seen that the ratio of the orifice bore length L to its diameter D ranges between about 3.6 to about 9.75. Also, it can be seen that the diameter of the central manifold is about 2.17 times greater than the largest orifice bore $O_8$. The overall dimensions of body member 16 are also relatively small. For example, for a plug member 27 having the approximate dimensions as above-described, body member 16 may have an outer diameter of 1.25 inches (31.75 mm.), and may have any overall height of about 0.850 inches (21.6 mm.). Thus, it can be seen that the adjustable variable flowrate orifice expansion device 13 of the present invention is relatively small and compact. Also, depending on the desired flowrate of refrigerant, orifice bores O are sized so as to ensure the refrigerant adiabatically expands downstream from the outlet end of the orifice bore. Those skilled in the art will recognize that the above dimensions are sized for one particular application, and that the number of orifices O provided in the plug body, the diameters of the various orifices, the lengths of the orifices, and all other dimensions may be sized according to the particular application intended for the expansion device 13 of the present invention.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. A selectively variable flowrate refrigerant expansion apparatus for use in a refrigeration system having an evaporator, comprising a main body having a flow path, said flow path having an inlet and an outlet for the flow of refrigerant therethrough, said main body having a plug member sealably mounted therein, said plug member being selectively rotatable relative to said main body between a plurality of discrete flow positions, said plug member having an outlet manifold in communication with the outlet of said flow path in said main body, said outlet manifold being generally coaxial with the axis of rotation of said plug member relative to said main body, said plug member further having a plurality of orifice bores each of a predetermined cross secion extending generally radially outwardly from said outlet manifold to the outer surface of said plug member, there being one radial orfice bore for each of said discrete flow positions such that with the plug member in one of its discrete flow positions only one selected orifice bore is in communication with the inlet of said flow path such that a predetermined flow rate of refrigerant will pass through said selected one of said orifice bore and be discharged into the outlet manifold, each of said orifice bores having a ratio of its length to its cross section ranging between about 3 and 12 so as to at least in part serve as a capillary tube and to provide a sufficient pressure drop of the refrigerant flowing therethrough such that substantially all of said evaporator is wetted with liquid refrigerant and yet so that only refrigerant vapor is discharged from said evaporator under a given load for said evaporator.

2. Apparatus as set forth in claim 1 wherein said main body has a counterbore therein rotatably, sealably receiving said plug member, said counterbore being defined by a cylindric side wall and by a flat bottom wall, said cylindric side wall of said main body having an opening therein in communication with the inlet of said flow path, and said bottom wall having a central opening therein in communication with said flow path outlet, said plug member being generally cylindric and having a cylindric side wall and a bottom wall generally perpendicular to said cylindric wall, with the plug member cylindric wall being in rotatable, sliding, sealing relation with the cylindric side wall of said main body.

3. Apparatus as set forth in claim 2 wherein said plug member has a central stem extending upwardly therefrom, and wherein said apparatus further includes a cover sealably secured to said main body, said cover having a central opening therein so as to permit access to said plug member stem for rotation of said plug member between its said discrete flow positions.

4. Apparatus as set forth in claim 3 further comprising seal means between said cover and said plug member so as to permit the rotation of said plug member within said main body between its said discrete flow positions without the leakage of refrigerant.

5. Apparatus as set forth in claim 2 further comprising means for positively positioning said plug member relative to said main body in each of its said discrete flow positions, with a desired orifice bore in register with said opening in said cylindric side wall of said main body member so that the flow of refrigerant through said apparatus is via said selected one orifice bore of said plug member.

6. Apparatus as set forth in claim 5 wherein said positively positioning means comprises a downwardly biased detent ball carried by said plug member extending below the bottom face of said plug member, a plurality of equally angular spaced recesses in said bottom wall of said main body member such that with said detent ball being received in a predetermined recess, a respective orifice bore in said plug member is in register with said opening in said main body cylindric side wall.

* * * * *